US006666160B1

(12) United States Patent
Örneblad

(10) Patent No.: US 6,666,160 B1
(45) Date of Patent: Dec. 23, 2003

(54) HIGH ASPECT DYNAMIC LIFT BOAT HULL

(76) Inventor: Sten Örneblad, Kvastekullavägen 8, 433 41, Partille (SE)

( * ) Notice: Subject to any disclaimer, the term of this patent is extended or adjusted under 35 U.S.C. 154(b) by 0 days.

(21) Appl. No.: 09/811,176

(22) Filed: Mar. 15, 2001

Related U.S. Application Data

(60) Provisional application No. 60/189,711, filed on Mar. 15, 2000.

(51) Int. Cl.[7] ..... B63B 1/32

(52) U.S. Cl. ..... 114/291; 114/271; 114/288

(58) Field of Search ..... 114/271, 291, 114/290, 288

(56) References Cited

U.S. PATENT DOCUMENTS

| | | | | | |
|---|---|---|---|---|---|
| 1,536,940 | A | * | 5/1925 | Sherburne | 114/271 |
| 1,831,339 | A | * | 1/1931 | Brush | 114/291 |
| 1,858,030 | A | * | 5/1932 | Batty | 114/271 |
| 2,396,721 | A | * | 3/1946 | Patterson et al. | 114/291 |
| 2,397,683 | A | * | 4/1946 | Nelson | 114/288 |
| 2,423,796 | A | * | 7/1947 | Platt, Jr. | 114/290 |
| 2,423,860 | A | * | 7/1947 | Van Patten | 114/291 |
| 2,555,307 | A | * | 6/1951 | Aylsworth | 114/291 |
| 2,634,698 | A | * | 4/1953 | Becker | 114/291 |
| 3,225,729 | A | * | 12/1965 | Ewing, Jr. | 114/271 |
| 3,316,874 | A | * | 5/1967 | Canazzi | 114/271 |
| 3,382,833 | A | * | 5/1968 | Wukowitz | 114/289 |
| 3,469,549 | A | * | 9/1969 | Rae | 114/288 |
| 3,547,064 | A | * | 12/1970 | Glass | 114/289 |
| 3,568,617 | A | * | 3/1971 | Yost | 114/291 |
| 3,661,109 | A | * | 5/1972 | Weiland | 114/291 |
| 3,967,571 | A | * | 7/1976 | Mut | 114/288 |
| 4,027,613 | A | | 6/1977 | Wollard | 114/291 |
| 4,231,314 | A | * | 11/1980 | Peters | 114/291 |
| 4,233,920 | A | * | 11/1980 | Wood et al. | 114/56 |
| 4,655,157 | A | | 4/1987 | Sapp | 114/291 |
| 4,708,085 | A | * | 11/1987 | Blee | 114/290 |
| 5,191,853 | A | * | 3/1993 | Adler | 114/291 |
| 5,443,026 | A | * | 8/1995 | Wenstadt et al. | 114/56 |
| 5,452,676 | A | * | 9/1995 | Fiore | 114/291 |
| 5,456,202 | A | * | 10/1995 | Schoell | 114/291 |
| 5,588,389 | A | * | 12/1996 | Carter, Jr. | 114/271 |
| 5,819,677 | A | * | 10/1998 | Livingston | 114/271 |
| RE36,879 | E | * | 9/2000 | Schoell | 114/291 |
| 6,250,246 | B1 | * | 6/2001 | Hubley | 114/288 |

FOREIGN PATENT DOCUMENTS

| | | | | |
|---|---|---|---|---|
| CA | 1005701 | * | 2/1977 | 114/288 |
| FR | 591988 | * | 7/1925 | 114/291 |
| FR | 831335 | * | 6/1938 | 114/291 |
| FR | 1052307 | * | 9/1953 | 114/291 |
| FR | 1536476 | * | 7/1968 | 114/288 |
| GB | 871446 | * | 6/1961 | 114/291 |
| GB | 1325159 | * | 12/1973 | 114/271 |
| GB | 1542639 | * | 3/1979 | 114/288 |
| IT | 515179 | * | 4/1955 | 114/291 |
| JP | 06-227478 | * | 8/1994 | 114/291 |
| SU | 469631 | * | 8/1975 | 114/291 |
| SU | 212082 | * | 3/1982 | 114/291 |
| WO | 8904273 | * | 5/1989 | 114/288 |

* cited by examiner

*Primary Examiner*—S. Joseph Morano
*Assistant Examiner*—Ajay Vasudeva
(74) *Attorney, Agent, or Firm*—Jeffrey Pearce

(57) ABSTRACT

An unventilated, stepped hydroplaning boat hull has at least one midship step. Two separated wetted planing surfaces are thereby established—a forward surface just forward of the step and an aft surface just forward of an aft edge of the hull. The angles of attack of each planing surface preferably lie in the range 2.0–6.5 degrees, and are preferably equal. The midship step is preferably located longitudinally in a range of 0.45 to 0.51 times the projected chine length of the hull, measured aftward from a forwardmost point of the chine.

11 Claims, 4 Drawing Sheets

HIGH ASPECT DYNAMIC LIFT BOAT HULL

CROSS-REFERENCE TO RELATED APPLICATIONS

This application claims priority of U.S. Provisional Patent Application No. 60/189,711 filed Mar. 15, 2000.

BACKGROUND OF THE INVENTION

1. Field of the Invention

This invention relates to a boat hull, in particular to hydroplaning hulls for high-speed motorboats.

2. Description of the Related Art

Ever since man first ventured onto the water in boats, he has tried to design hulls that increase speed without unduly sacrificing stability. This is of course, by definition, the main goal of designers of motor-powered speed boats, for which an increase in knots per horsepower is usually more important than an increase in load-carrying capacity.

One obvious way to increase speed is simply to increase engine power. There are several disadvantages to this solution, however. First, more powerful engines are generally heavier, which means that even more mass must be moved. Second, increased engine mass usually requires a redesign of the hull in order to provide for optimum balance under way, especially in the case of outboard engines. Third, more powerful engines also usually cost more and have greater fuel consumption than smaller powerplants.

In addition to inertia, two primary forces work against increased speed for boats, namely, the resistance of the air (aerodynamic drag) against the above-water structure of the boat and the resistance of the water (hydrodynamic drag) on the wetted surface of the hull. Many solutions have been proposed for reducing both forms of drag.

Hydrodynamic drag can be reduced not only by better streamlining the hull to minimize areas of turbulence and thus wasted energy, but also by reducing the wetted surface area of the hull. As is well known, one way to reduce the wetted area is for the hull to act as a hydroplane, such that the hull rises out of the water when at cruising speed. One way to enable hydroplaning is to mount hydrofoils on the hull, either near the bow, or both bow and aft. This of course adds structural complexity and greatly reduces the efficiency of the boat at non-hydroplaning speed.

It is also possible configure the hull itself with a step that acts as a planing surface. Examples of such stepped hulls are disclosed in the following references:

U.S. Pat. No. 4,655,157 (Sapp, Apr. 7, 1987);

U.S. Pat. No. 4,231,314 (Peters, Nov. 4, 1980);

U.S. Pat. No. 4,027,613 (Wollard, Jun. 7, 1977); and

U.S. Pat. No. 5,191,853 (Adler, Mar. 9, 1993).

One problem with stepped hulls is that they often create under-pressure—a vacuum—behind the steps. This vacuum tends to "suck" the hull down, thereby increasing drag and reducing efficiency. One common way to overcome this problem is to build channels into the hull, for example, perpendicular to or along the strakes, that direct air into the region(s) behind the step(s) to compensate for any vacuum effect. These hulls are commonly referred to as "ventilated" or "aerated" hulls.

What is needed—and always sought after—is a boat hull that allows for even greater speed for a given motor effect, or that achieves a given speed with less motor effect, compared with existing hulls. This invention provides such a boat hull.

SUMMARY OF THE INVENTION

The invention provides a hydroplaning boat hull that has: a forward portion; an aft portion; at least one midship step separating the forward and aft portions; a forward planing surface that extends transversely immediately forward of the midship step and has a forward angle of attack; and an aft planing surface portion that extends transversely and forward of an aft edge of the hull and has an aft angle of attack. The forward angle of attack lies in the range 2.0–6.5 degrees, and when the hull is moving at least at a minimum planing speed, the forward and aft planing surfaces constitute two separated wetted surfaces.

In the preferred embodiment of the invention, the forward and aft angles of attack are equal. Moreover, at least the forward angle of attack is preferably 5.5 degrees when the deadrise D of the hull is 18 degrees; the deadrise itself is preferably at least 16 degrees. At least the forward angle of attack is preferably related to the deadrise as follows: Given a reference angle of attack of 5.5 degrees, for every degree by which D exceeds 18 degrees, the forward angle of attack is preferably increased by an increment A above the reference angle of attack, and for every degree by which D is less than 18 degrees, the forward angle of attack is preferably decreased by the increment A below the reference angle of attack. The optimum value for A has been found to be 0.1 degrees.

The longitudinal location of the midship step also affects performance. In the preferred embodiment of the invention, given a projected chine length L, the midship step is preferably located longitudinally in a range of 0.45 to 0.51 times L, measured aftward from a forwardmost point of the chine; the optimum position of the step has been found to lie a position 0.48 times L, again measured aftward from the forwardmost point of the chine.

Both the aft and forward portions are preferably twisted, each with a deadrise angle at the keel line that increases from a respective leading edge forward.

The preferred embodiment of the hull is unventilated.

DETAILED DESCRIPTION

Figure 1:
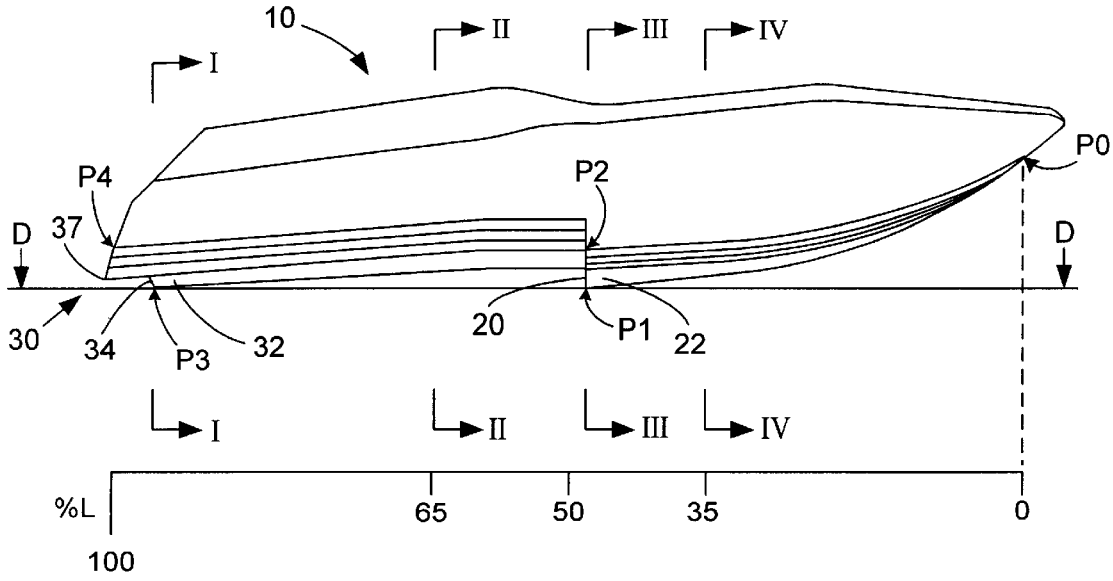
FIG. 1 is a side view of a stepped boat hull according to the invention.
Figure 2:
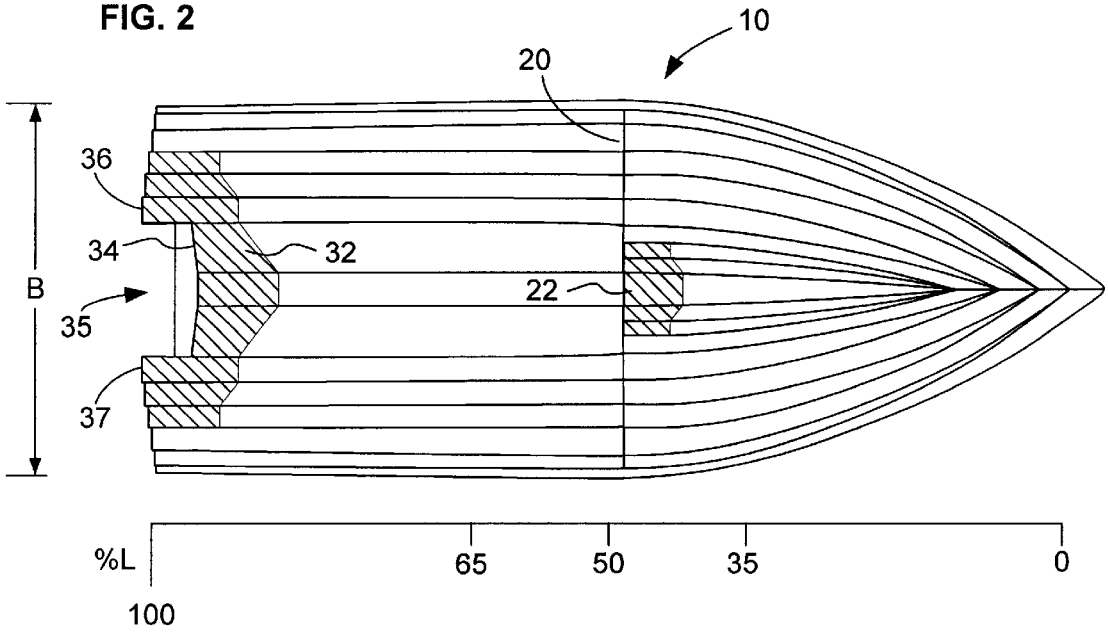
FIG. 2 is a bottom view of the boat hull according to the invention.
Figure 3:
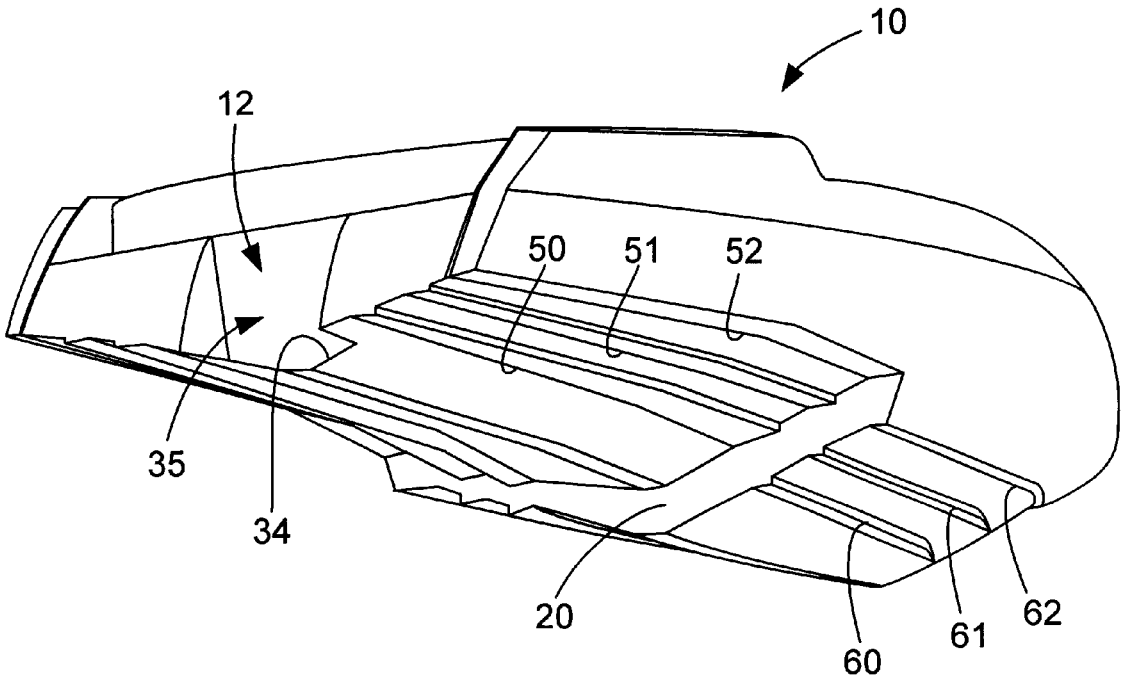
FIG. 3 is a perspective view of the boat hull according to the invention viewed from a point below and behind the aft, starboard portion of the hull.
Figure 4A:
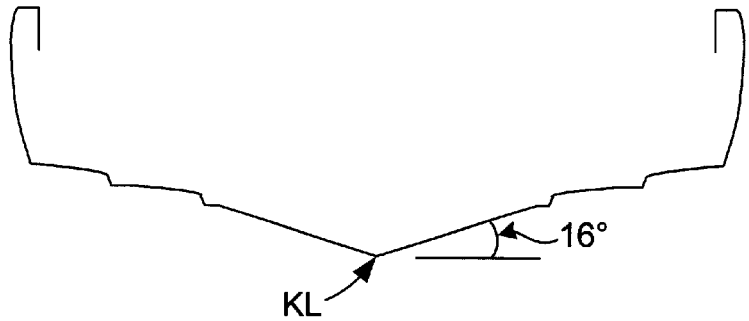
FIGS. 4A–4D are cross-sectional views of the boat hull according to the invention taken along lines I—I, II—II, III—III and IV—IV, respectively, in FIG. 1.
Figure 4B:
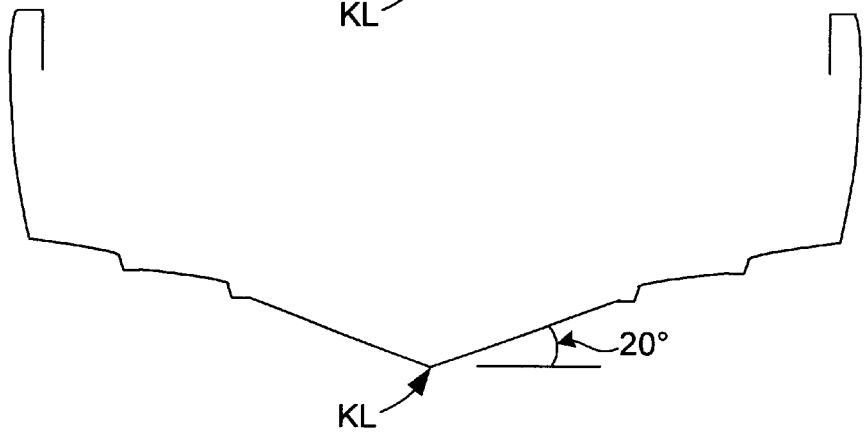
Figure 4C:
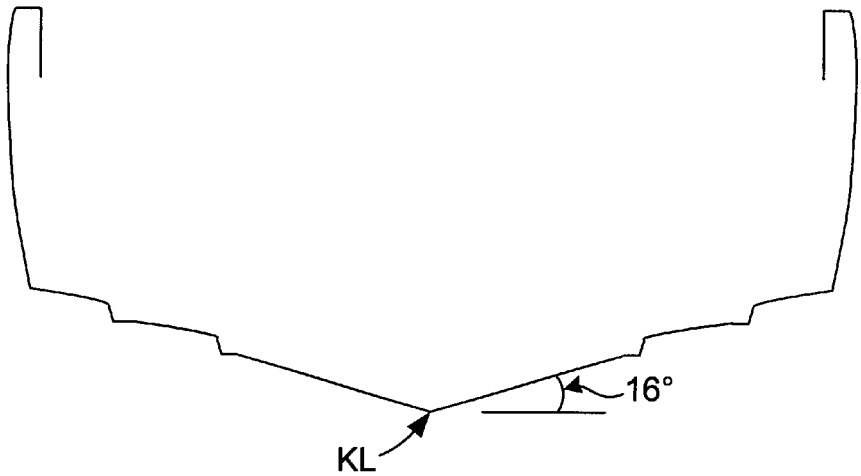
Figure 4D:
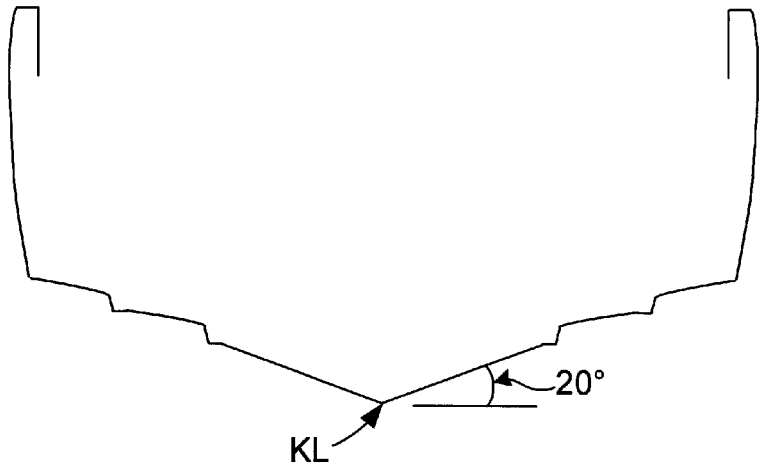

The invention provides a stepped, V-bottomed boat hull for use preferably in high-speed motorboats. FIGS. 1 and 2 show a side and bottom view, respectively, of the hull 10 according to the preferred embodiment of the invention; FIG. 3 is a perspective view from a point below and behind the aft, starboard portion of the hull. The hull may be manufactured of any standard material such as fiberglass or aluminum. The embodiment of the invention described below is based on a working prototype of the hull, which was made of fiberglass.

Main Structural Features

The hull according to the invention is for a motor boat. Consequently, at least one outboard or stern drive engine and a propeller (or water jet unit) will normally be mounted on the transom 12. These are not shown in the figures because they are both well known in the art of boat design and the invention does not require any particular type of propulsion system—any system that can get the hull to a planing speed will benefit from the invention. Nonetheless, by way of example, one working prototype of the invention used a 1999 Mercury ELPT 135 horsepower (hp), gasoline-fueled, outboard engine driving a 13⅞×21-inch (diameter×pitch) Laser propeller and raised 32 mm, and tests (described below) were conducted while the hull carried two adults, 80 liters of gasoline, and standard equipment.

In FIG. 1, a datum line is indicated as the line D—D, and a length scale is shown extending from 0 to 100% the projected chine length L of the hull, measured aftward from a bow reference point P0 at the forwardmost point of the chine. The description below adopts the following convention: Whenever it is stated that a feature is located at a position "x% L", this is to mean that the feature is longitudinally located x percent of the projected chine length L aftward from P0. The maximum beam B of the boat hull is indicated in FIG. 2. Note that FIGS. 1 and 2 are to scale. In the prototype of the invention for which absolute and comparative test results are given below, the length L was 6.30 m and the beam B was 2.40 m. Without the engine, this prototype weighed 700 kg. Without departing from the main features of the invention, these dimensions may of course be adjusted using experimental design methods and will depend on such factors as expected load, chosen engine, etc.

As in conventional hydroplaning hulls, the hull according to the invention is preferably provided with lift strakes, which are longitudinal members or portions running fore and aft on the outside bottom of the hull in order to stabilize and create lift on the deep-V hull when under power. FIG. 3 shows aft strakes 50, 51, 52 aft of the step 20 and forward strakes 60, 61, 62 forward of the step, all on the starboard side of the hull. Corresponding strakes that mirror these are of course provided on the port side of the hull as well.

The main feature of the invention is a midship step 20 that extends transversely. The midship step 20 extends substantially perpendicular to the datum line D—D, although it may also angle aft (with the upper portion farther aft than the lower) by as much as 20 degrees without significantly affecting performance. Tests have demonstrated that the longitudinal position of the midship step significantly affects the performance of the hull. The midship step 20 is therefore preferably located longitudinally in a range of 0.45 to 0.51 times the projected chine length L, measured as shown in the scale in FIG. 1 (which, in one prototype of the invention, was in the range of 49–55% of the overall hull length, measured from the tip of the bow). The optimum position has been found to be 0.48 times L, measured aftward from the forwardmost point P0 of the chine.

Of course, when the hull is in the water, the aft portion 30 of the hull will also be in contact with the water. As FIGS. 2 and 3 most clearly show, a recessed area 35 is preferably provided in the transom 12, in which at least part of the engine (typically, the transmission to the propeller) will normally be mounted. As FIG. 2 illustrates the aftmost edge of the recess is preferably located approximately 9–14% of the way from the stern to the step 20. The aft of the hull therefore has a trailing edge comprising not only the aftmost edge 34 of the recess, but also the trailing edges 36, 37 of the hull on either side. Viewed another way, the hull is lengthened aft 10–16% of the afterbody's length and on either side of the transom stern 12. Underway, this causes water pressure to build up outboard of the transom stern on either side while remaining zero in between. This in turn substantially improves transverse stability and prevents swinging.

When the hull is moving at least at a minimum planing speed through the water, the hull according to the invention exhibits two separate—and separated—planing, wetted surfaces: A forward planing surface 22 that extends just forward of the midship step 20, and an aft wetted surface 32 that extends just forward of the trailing edge of the hull. In FIG. 2, the approximate position and size of these planing surfaces 22, 32 are shaded. Note that the planing surfaces are the only surfaces of the hull that are in contact with the water, that is, they are the only wetted surfaces, when the boat is moving at at least a minimum hydroplaning speed. The faster the boat moves, the smaller the surfaces 22, 32 become.

Lower Drag

As is well understood in the art of hull design, and as is intuitive, the smaller the wetted area of a hull is, the less hydrodynamic drag there will be on the hull. As in other hydroplaning hulls, the faster the hull moves, the smaller the wetted areas become. At a high planing speed, which, for boats of roughly seven meters in length, means a speed in the range of 50 to 60 knots, the hull according to the invention has been found in tests to have a total wetted area as much as 60% less than that for a conventional V-bottom or flat-bottom hydroplaning hull, and up to 40% smaller than that for a so-called ventilated hull. This is in part thanks to the fact that, as FIG. 2 shows, the region between the wetted areas (the planing surfaces) 22, 32 is above the water at speed, and contrasts with conventional straight, V-bottom hulls, in which the wetted area is a single, large, roughly triangular region extending from the stern to midship. Moreover, the hull according to the invention is self-adjusting, so that no motor trim is needed; this in turn keeps the propeller force horizontal, thus maximizing the driving force.

High Aspect Ratio

The concept of the "aspect ratio" (AR) of a lifting body is well understood in aero- and hydrodynamics. As a rule of thumb, AR=B/Sqrt(A), where B is the breadth or beam (dimension perpendicular to the direction of flow) and A is wetted surface area. The higher the aspect ratio is, the more lift the body will generate for a given value of A and a given flow speed. Thus, a long sailplane wing with a short chord generates much more lift at any given speed than a stubby wing, that is, a short wing with a long chord. Similarly, a deep, narrow centerboard or keel creates more lift than a keel with shoal (shallow) draft. In the context of planing hull surfaces, the lateral extension (the "width") corresponds to B. For greatest efficiency, therefore, a planing surface should have a short chord length but be wide.

As FIG. 2 shows, the fore-aft and transverse dimensions of the forward planing surface 22 are approximately in the ranges 6–12% L and 22–32% B, respectively. The fore-aft and transverse dimensions of the aft planing surface 32 are approximately in the ranges 8–15% L and 60–70% B, respectively. The aft planing (wetted) surface 32 is therefore much wider than, but about as long (fore-aft) as, the forward planing (wetted) surface of the bottom of the hull according to the invention.

This high aspect ratio, especially for the aft planing surface 32, provides much greater lifting force and less drag than can be achieved in conventional V-bottom or "ventilated" hydroplane hull designs.

Less Induced Drag

As is also well known, a drag-inducing vortex is created at the outboard edges of each planing surface of a hydroplane hull. This induced drag is usually the greatest drag force on a planing hull. Along the keel line, the stream line will generally be along the keel line itself, that is, it will have no lateral component, and as such will generate maximum pressure and lifting force. The stream lines at the turbulent edges of planing surfaces, however, will have significant lateral components, which implies much lower pressure and little if any lift, although high drag. Lifting strakes are therefore usually provided to help direct water aftward, more parallel to the keel line and thereby to provide higher pressure and greater lift.

As is mentioned above, conventional planing hulls have a single, large, planing surface that widens as it goes aft. This large area has a correspondingly large turbulent edge. Indeed, a traditional, non-stepped planing hull will have a disturbed (turbulent) area about four times as large (with correspondingly increased drag) as that of the hull 10 according to the invention. Even so-called ventilated hulls have two to three times more disturbed area due to their increased tip vortex.

Balance Between Centers of Gravity and Lift

As is pointed out above, the two wetted, planing surfaces have approximately the same fore-aft extension. Furthermore, the separation between the centers of lift of these two surfaces lies in the range of 46–52% L. When the hull according to the invention is planing, it is "riding" on the two planing, wetted surfaces 22 and 32. Recall also that, as speed increases, the surface area of the wetted surfaces will decrease. The distance between the centers of lift in the hull according to the invention, however, will remain substantially constant—any change in this distance will in any case not be a large viewed as a percentage of the total separation. The hull according to the invention therefore has two dynamic centers that remain substantially in the same position relative to the center of gravity of the hull at any given planing speed. This leads to yet another advantage of the invention: The hull is substantially free of "porpoising" or "galloping," which is a phenomenon known to increase drag by around 5% due to the increased wetted area when the hull "falls;" moreover the up-down "porpoising" motion itself creates an energy loss.

More Dynamic Lift

It is known that the center of lifting force of a planing area is roughly one third of the chord length of the surface, measured from the leading edge—the closer to the trailing edge of a lifting surface one measures, the closer it gets to zero. In the hull according to the invention, there are two separate leading edges (one per planing surface), which therefore provide more dynamic lift than a single surface of the same area.

Angles of Incidence and Bottom Twist

One important feature of the invention that makes all the aforementioned advantages (as well as those mentioned below) possible is the angle of incidence, also known as the angle of attack, of the planing surfaces 22, 32. Let a1 and a2 be the effective angles of attack of the forward and aft planing surfaces 22, 32, respectively. Note that the hull according to the invention is not flat-bottomed; indeed, as is shown below, the hull 10 preferably is a deep, V-bottomed hull, which is traditionally take to mean a hull with a hard chine, having a deadrise angle of at least 15 degrees at the transom. Taking the datum line D—D as the horizontal reference, the angle of attack will thus vary from the trailing edge of the step 20 at the keel line out to the chine; the same applies at the trailing edge of the aft planing surface. The effective forward and aft angles of attack are therefore defined here as the average of the respective angles of attack at the keel line and at the chine.

Experiments (discussed below with reference to FIG. 5) by the inventor have demonstrated that if the planing areas on the stepped hull are twisted instead of being straight V-bottom sections, then the lifting force increases and the hull planes at lower speeds. For example, the stepped hull with the twisted sections and an average deadrise of 18 degrees has better performance than a straight V-bottom, stepless hull built to the same size at a Froude number of 0.8 and the stepped hull with the straight sections has better performance at Froude number of 1.2. It would be possible, however, to include the other features of the invention on a non-twisted hull, although the performance advantages of the invention will then be significant only for speeds corresponding to a Froude number of about 1.2 (for a six-meter hull, about 18 knots). Including the preferred hull twist allows the hull according to the invention plane at lower speeds, even as low as speeds corresponding to a Froude number of about 0.8 (for a six-meter hull, about 12 knots).

This means that a 6-meter stepped boat with twisted V-bottom sections is, at 12 knots, easier to propel than a stepless, straight V-bottom boat built to the same dimensions. Moreover, a 6-meter stepped boat with straight V-bottom sections is, at 18 knots, easier to propel than a stepless straight V-bottom boat built to the same dimensions.

One reason twisted hulls provide better performance is that they give a more even lateral pressure distribution and a higher dynamic pressure on the bottom. Twisted V-bottoms do not generally work satisfactorily on stepless hulls because these bottoms tend to build up more pressure aft than amidships, which makes the foreship tend to squat The invention compensates for any such tendency by using two planing surfaces. Moreover, by giving the chine a higher angle of incidence (attack) than the keel line, higher pressure is created farther out. This gives a more even pressure distribution and thus a greater lifting force. This is also the theoretical explanation for why it is preferable for the greater angle of attack at the chine than at the keel. Here, the keel line angle of attack at the step 20 is defined as the angle the hull makes with the horizontal at and extending forward from point P1 in FIG. 1; the forward chine angle of attack is the angle the chine makes with the horizontal at and extending forward from point P2, located above P1, in FIG. 1. Similarly, the aft keel line angle of attack is defined as the angle the hull makes with the horizontal at and extending forward from point P3 in FIG. 1; the aft chine angle of attack is the angle the chine makes with the horizontal and extending forward at the aftmost point P4 of the chine.

Experiments have shown that the difference in the angles of attack at the keel line and at the chine both at the step an aft, should lie in a range of 1.0 to 4.0 degrees, with an optimum difference of 2 degrees. With a deadrise of 18 degrees (discussed below), the optimal chine and keel line angles of attack—$\alpha_c$ and $a_k$—should be 6.5 and 4.5 degrees, respectively, leading to optimal effective angles of attack of (6.5+4.5)/2=5.5 degrees both. In general, however, the experiments showed that the angles $\alpha_c$ and $\alpha_k$ should be kept in the range of 2.0–6.5 degrees, and preferably, although not necessarily, equal. Let D be the deadrise angle. The angles $\alpha_c$ and $\alpha_k$ should be increased by a value $\delta$ for each degree of increase in the deadrise angle D above 18 degrees, and decreased by $\delta$ for every degree of decrease in the deadrise angle D, where $\delta$ lies in the range 0.01–0.2 degrees; optimally, $\delta$=0.1 degrees. Note by way of comparison that the approximate optimum angle of attack for a flat-bottom (deadrise=0 degrees) therefore is 5.5–0.1*(18–0)=3.7 degrees.

The twisted V-bottom in the preferred embodiment of the invention can also be defined in terms of the difference in deadrise at the keel from the stern forward: FIGS. 4A–4D are cross-sectional views of the boat hull according to the invention taken along lines I—I, II—II, III—III and IV—IV, respectively, in FIG. 1, with lines I—I and III—III representing the positions of the trailing edge 34 and the step 20, respectively. The keel line of the hull is the line that extends perpendicular to the plane of the figures and through the point KL shown in the figures.

As FIGS. 4A–4D illustrate, the V-bottom hull according to the invention is therefore preferably twisted, with a deadrise angle at the keel increasing continuously from the stern towards the step, decreasing at the step itself, and then increasing continuously from the step forward. In one working prototype of the invention, the deadrise angles at the positions I—I, II—II, III—III and IV—IV were 16, 20, 16, and 20 degrees, respectively. The twist aft of the step is therefore (20–16)=4 degrees, with an average deadrise of (20+16)/2=18 degrees. The same holds forward of the step, although the forward entry may be given a deeper V-bottom (greater deadrise angle) in order to achieve a softer ride in seaways.

Experiments by the inventor have shown that if a slow planing speed, down to a Froude number of roughly 0.8 (corresponding to 12 knots for a 6-meter boat) is preferred, then the deadrise at the stern of both the forward and aft sections of the hull (forward and aft of the step 20, respectively) should have a deadrise of 16 degrees and a twist of four degrees. If a softer ride in seaways is desired, then the deadrise should be increased to 18 degrees, still with a four degree twist. If a very soft ride is desired, then the deadrise can be increased even further, to as much as 30 degree and possibly even more, although such an extreme deadrise will make it increasingly difficult if not impossible for the hull to hydroplane at all: Higher deadrise increases the transverse stability at high planing speeds, that is, in the range of 50 knots and up, but is disadvantageous with respect to slow planing speed and makes the boat unsteady when it is standing still.

The deadrise of 16 degrees at the stern and amidships (lines I—I and III—III) may be both increased and decreased, depending on the desired characteristics and expected operating conditions. Note that having a higher deadrise closer to the leading edge of each bottom plane and giving the chine a higher angle of incidence than the keel line increases the lifting force. One disadvantage of a trailing edge deadrise less than 16 degrees is that this creates a tendency toward hard slamming in a seaway.

Published tests have shown, for example, that a boat 18 meters in length crossing 1.2–1.5 meter waves at a speed of 34 knots registered pressures of 0.7 kg per square cm and acceleration of 6 g. Higher deadrise thus makes for a softer ride in heavy sea.

Hydrodynamic Transverse Stability

As FIG. 2 illustrates, and as is mentioned above, the portion 34 of the trailing edge of the aft planing surface 32 is located forward, by approximately 9–14% of the length from the stern to the step, relative to the edge portions 36, 37 outboard on either side. The effect of this is that, at the far aft of the hull (especially aft of the edge 34), the planing surface acts as a "catamaran" in that greater dynamic lift is built up on the outboard portions of the planing surface 32 than near the keel line. This helps prevent chine walking ("swinging").

Unventilated

Many different advantages of the hull according to the invention are described above. One should note that the invention is able to achieve all of these with a hull that is unventilated. It would be possible to ventilate the hull according to the invention, but the inventor has found that the other unique features of the invention do not depend on this and that ventilation provides no advantage.

Multi-Step Hull

The inventor has found through testing that the single midship step 20 with the characteristics explained above provides the optimum performance. It would be possible, however, to design a hull with more than one step between the aft planing surface 32 and the bow. Each such step should preferably have the characteristics—angles of attack, inter-planing surface twist, deadrise ranges, etc.—of the step 20.

Comparative Results

The invention compared the performance of the hull according to the preferred embodiment of the invention with several other conventional hulls under essentially identical sea states and with the same two-person load. The specification of the embodiment of the invention used in the test are stated above with reference to the working prototype. The results are summarized in Table 1 below. In Table 1 are shown, for each tested hull, the make and model, length× beam in meters (m), the mass (kg), the motor effect (in horsepower), the percent difference Δeffect in effect relative to the 135 hp of the invention, the maximum achieved speed vmax (knots), and the percent improvement Δvmax in maximum speed the hull according to the invention achieved relative to the conventional hulls. The motors used had a horsepower rating standard for each respective boat model.

As Table 1 shows, no other hull exceeded the 48 knot top speed of the invention. Only two (the Flipper and the Roballo) tied it, but required motor effects 48% and 67% greater than the 135 hp used by the invention to do so. In two cases—the Yamarin Big Ride and the Bayliner 1802 Capri LS—the conventional hulls operated driven with 4% and 7% less effect, respective, but their respective top speeds were 13% and 23% less than that attained by the invention. Note also that the Regal 2100 LSR is a representative of ventilated hulls.

Figure 5:
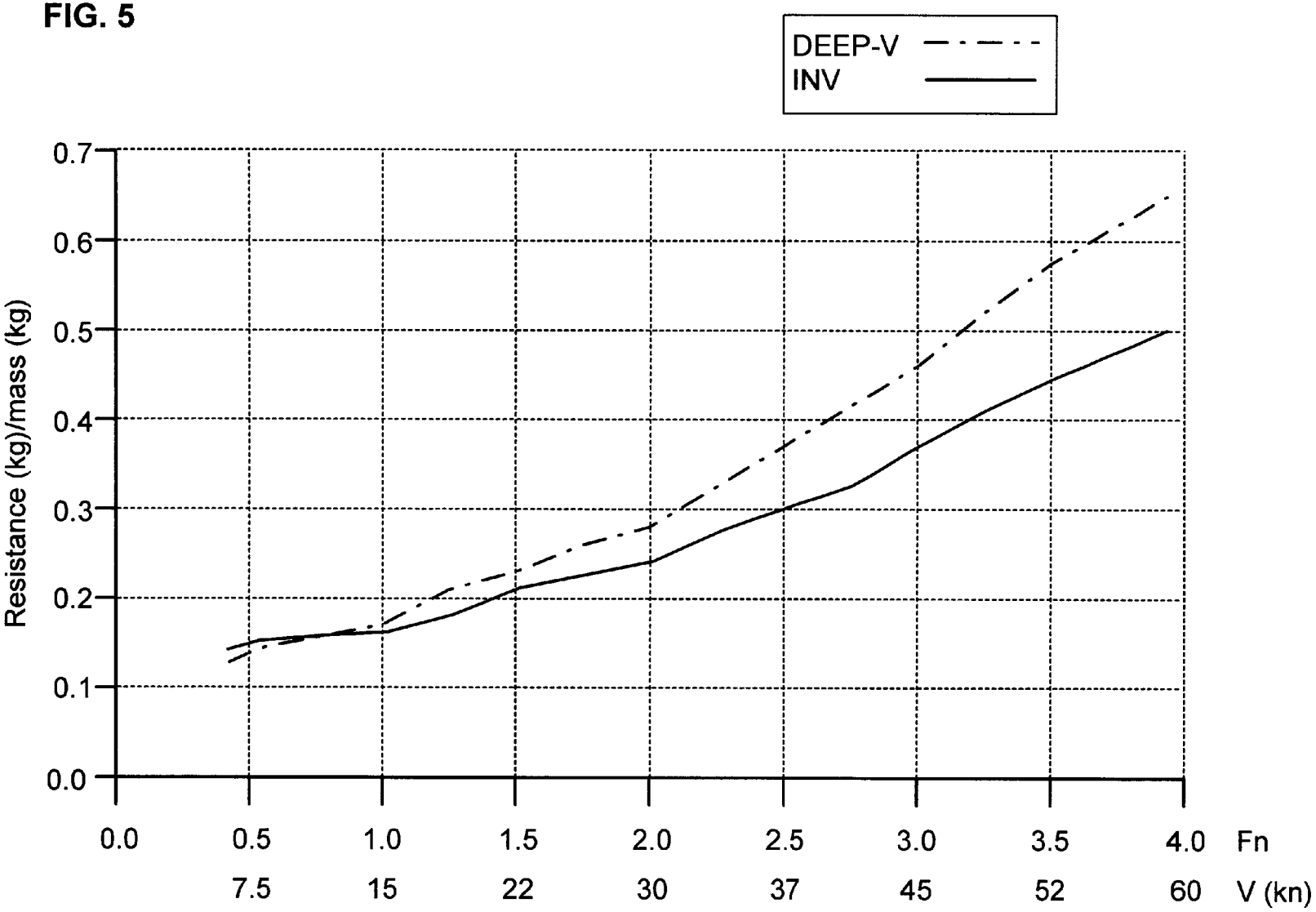
FIG. 5 is a plot of the results of a test of comparative resistance at different speeds for a straight deep-V hull according to the prior art and for a hull according to the preferred embodiment of the invention.

FIG. 5 is a plot that shows the results of a test of resistance (measured in kilograms using a standard dynamometer) per unit mass (also in kilograms) as a function of velocity V in knots for two hull models: the hull according to the invention (plotted as a solid line) and a stepless, straight (untwisted), deep-V hull with characteristics similar to those of similarly configured hulls according to the prior art.

The results plotted apply to models corresponding to six-meter hulls. As is well known in the art of hydrodynamic design, the Froude number Fn relates to velocity V and waterline length Lwl as follows:

$$Fn=V/SQRT(g*Lwl)$$

where V is expressed in meters per second, g is the gravitational constant, Lwl is expressed in meters, and SQRT represents the square root. In FIG. 5, velocity V has been converted to knots merely to make the plot more intuitively understandable. Note that results for other values of Lwl can be determined simply by substituting the appropriate value of Lwl into the equation for Fn. Thus, for a 9-meter hull and Fn=0.8, the corresponding speed would be about 14.6 knots.

Both models were built and tested according to the following specifications:

Basin: Ocean

Water temperature: 20 degrees Celsius

Material: Fiberglass

Finish: Paint

Deadrise: 24 degrees

Lwl: 1.20 m (model length at design load waterline)

B: 0.44 m (model beam)

Ratio Lwl/B: 2.7

Mass: 7.1 kg (including outboard model)

A summary of the results illustrated in FIG. 5 is as follows:

| V (kn) | Relative drag of hull according to the invention |
|---|---|
| 1–6 | displacement speed -- 10% more drag |
| 12–13 | planing begins, drag equal |
| 20–25 | approx. 10% less drag |
| 30–40 | approx. 15% less drag |
| 40–50 | approx. 17–20% less drag |
| 50–60 | approx. 25% less drag |

As these tests show, with equivalent propulsion, the twist and the step according to the invention improve the achievable speed of the hull significantly for all speeds above about 20 knots, and at least measurably above about 12 knots. Moreover, the twisted bottom according to the preferred embodiment of the invention was more easily propelled than a deep V-bottom hull of the same size at 12–13 knots (Froude number approximately 0.8), and also more easily propelled at 18 knots (Froude number 1.2) for hulls with straight V sections.

TABLE 1

| Make Model | Length × Beam (m) | Mass (kg) | Motor effect (hp) | Δeffect (%) | vmax (knots) | Δvmax (%) |
|---|---|---|---|---|---|---|
| Invention | 6.30 × 2.40 | 700 | 135 | — | 48 | — |
| Flipper | 6.40 × 2.40 | 900 | 200 | +48 | 48 | 0 |
| Askeladden | 6.35 × 2.45 | 950 | 135 | 0 | 42 | +14 |
| Finnmaster | 6.00 × 2.30 | 700 | 150 | +11 | 43 | +12 |
| Buster | 6.30 × 2.40 | 800 | 150 | +11 | 41 | +17 |
| Silver Eagle Rygs 600 | 6.00 × 2.40 | 670 | 150 | +11 | 41 | +17 |
| Seamaster | 6.00 × 2.20 | 620 | 140 | +4 | 36 | +33 |

TABLE 1-continued

| Make Model | Length × Beam (m) | Mass (kg) | Motor effect (hp) | Δeffect (%) | vmax (knots) | Δvmax (%) |
|---|---|---|---|---|---|---|
| Yamarin Big Ride | 5.78 × 2.18 | 620 | 130 | −4 | 42 | +14 |
| Crescent Roballo 2100 | 6.10 × 2.35 | 650 | 135 | 0 | 42 | +14 |
| Bayhunter Stingray 200C | 6.22 × 2.47 | 920 | 225 | +67 | 48 | 0 |
| Regal 2100 LSR | 6.20 × 2.34 | 880 | 190 (Stern drive) | +41 | 47 | +2 |
| Uttern 6402 | 6.40 × 2.50 | 900 | 190 (Stern drive) | +41 | 46 | +4 |
| Bayliner 2109 Rendez. | 6.38 × 2.51 | 960 | 190 (Stern drive) | +41 | 40 | +20 |
| Searay Laguna 21 | 6.30 × 2.52 | 1220 | 175 | +30 | 39 | +23 |
| Glastron GX 180 | 6.35 × 2.44 | 1120 | 150 | +11 | 35 | +37 |
| Bayliner 1802 Capri LS | 5.40 × 2.30 | 644 | 135 | 0 | 42 | +14 |
| | 5.40 × 2.11 | 680 | 125 | −7 | 37 | +30 |

What is claimed is:

1. A hydroplaning boat hull comprising:

a forward portion;

an aft portion;

a single keel line extending fore and aft and lying in a single vertical plane of symmetry;

at least one midship step separating the forward and aft portions;

a single forward planing surface extending transversely immediately forward of the midship step and having a nominal forward angle of attack;

an aft planing surface portion extending transversely and forward of an aft edge of the hull and having a nominal aft angle of attack;

said nominal forward and aft angles of attack being measured in the plane of symmetry between the hull and a datum line that extends fore and aft and passes through lowest points of the forward and aft portions, respectively;

in which:

the hull is a V-bottom monohull;

both the aft and forward portions are individually twisted, each with a deadrise angle at a keel line that increases from a respective leading edge forward;

the nominal forward angle of attack lies in the range 3.1–6.5 degrees; and when the hull is moving at least at a minimum planing speed, the forward and aft planing surfaces constitute two separated wetted surfaces.

2. A boat hull as defined in claim 1, in which the forward and aft angles of attack are equal.

3. A boat hull as defined in claim 1, in which the forward angle of attack is 5.5 degrees.

4. A boat hull as defined in claim 1, in which the hull has a predetermined deadrise of at least 16 degrees.

5. A boat hull as defined in claim 4, in which:

the predetermined deadrise is D degrees and the hull has a reference angle of attack of 5.5 degrees; and the forward angle of attack is related to the predetermined deadrise as follows:

$$\alpha=5.5+(D-18.0)*\delta$$

where $\alpha$ is the forward angle of attack and $\delta$ is a predetermined increment.

6. A boat hull as defined in claim 5, in which $\delta$ is 0.1

7. A boat hull as defined in claim 1, in which:

the hull has a projected chine length L; and the midship step is located longitudinally in a range of 0.45 to 0.51 times L, measured aftward from a forwardmost point of the chine.

8. A boat hull as defined in claim 7, in which the midship step is located longitudinally at a position 0.48 times L, measured aftward from the forwardmost point of the chine.

9. A boat hull as defined in claim 1, in which the hull is unventilated.

10. A hydroplaning boat hull comprising:

a forward portion;

an aft portion;

a single keel line extending fore and aft and lying in a single vertical plane of symmetry;

a midship step separating the forward and aft portions;

a single forward planing surface extending transversely immediately forward of the midship step and having a nominal forward angle of attack;

a single aft planing surface portion extending transversely and forward of an aft edge of the hull and having a nominal aft angle of attack;

said nominal forward and aft angles of attack being measured in the plane of symmetry between the hull and a datum line that extends fore and aft and passes through lowest points of the forward and aft portions, respectively;

in which:

the hull is a V-bottom monohull;

the hull has a deadrise of at least 16 degrees;

both the aft and forward portions are individually twisted, each with a deadrise angle at a keel line that increases from a respective leading edge forward;

the nominal forward and aft angles of attack lie in the range 3.1–6.5 degrees;

the hull has a projected chine length L; and the midship step is located longitudinally in a range of 0.45 to 0.51 times L, measured aftward from a forwardmost point of the chine; and when the hull is moving at least at a minimum planing speed, the forward and aft planing surfaces constitute two separated wetted surfaces.

11. A hydroplaning boat hull comprising:

a forward portion;

an aft portion;

a single keel line extending fore and aft and lying in a single vertical plane of symmetry;

at least one midship step separating the forward and aft portions;

a single forward planing surface extending transversely immediately forward of the midship step and having a forward angle of attack $\alpha$;

an aft planing surface portion extending transversely and forward of an aft edge of the hull and having an aft angle of attack;

said nominal forward and aft angles of attack being measured in the plane of symmetry between the hull and a datum line that extends fore and aft and passes through lowest points of the forward and aft portions, respectively;

in which:

the hull is a V-bottom monohull;

the hull has a predetermined deadrise D of at least 16 degrees;

the forward angle of attack is related to the predetermined deadrise as follows:

$$\alpha=5.5+(D-18.0)*0.1;\text{ and}$$

when the hull is moving at least at a minimum planing speed, the forward and aft planing surfaces constitute two separated wetted surfaces.

* * * * *